United States Patent [19]

Clark

[11] Patent Number: 4,648,404

[45] Date of Patent: Mar. 10, 1987

[54] COORDINATED NURSING SLIP AND BRA

[76] Inventor: Susan A. Clark, 128 Hopeland La., Sterling, Va. 22170

[21] Appl. No.: 559,663

[22] Filed: Dec. 9, 1983

[51] Int. Cl.[4] ..... A41C 3/08

[52] U.S. Cl. ..... 128/455; 2/104

[58] Field of Search ..... 128/455, 460, 454, 457; 2/104; 223/106, 107, 108, 109

[56] References Cited

U.S. PATENT DOCUMENTS 3,176,692 4/1965 Marino ..... 128/460

*Primary Examiner*—Doris L. Troutman

*Attorney, Agent, or Firm*—John L. Hummer

[57] ABSTRACT

A functionally coordinated nursing slip and nursing bra enable a working mother to breast feed her infant without having to make any indecorous motions that attract unwanted attention, in order to adjust her nursing undergarments. This is accomplished without affecting the stylishness, strap adjustability, or concealment otherwise provided by the slip. Similarly, the functionality of the nursing bra is not reduced. The coordination arrangement allows the opened slip to be fully supported by the nursing bra. The opened slip parts are retained handily by the coordinated bra so that reclosure is easily done. Thus all need for the mother to seek total privacy in nursing is eliminated, and she can nurse around other persons with minimal embarassment.

15 Claims, 5 Drawing Figures

COORDINATED NURSING SLIP AND BRA

BACKGROUND OF THE INVENTION

1. Field of the Invention

This invention relates generally to the clothing arts, and particularly to a novel slip and bra which are coordinated to enable a working or socially active mother to nurse her baby in semi-public surroundings with minimal social embarassment. The attention-attracting problems of conventional commercially available undergarments are eliminated by the invention.

2. Prior Art

A serious and currently unsolved problem exists today for the many mothers who want to wear fashionable clothes to actively participate in business and social affairs, and who also wish to be able to nurse their infants conveniently. There are nursing bras and nursing nightgowns, but no other nursing undergarments are commercially available for a working mother.

A most serious deficiency is the lack of a nursing slip or camisole. With a conventional slip, a mother has to pull a regular slip shoulder strap down over her shoulder quite a distance in order to nurse her baby. This is virtually impossible with some kinds of outerwear sleeves, and the action is always awkward and uncomfortable, as it is accomplished only with a lot of indecorous motions that invariably attract attention.

The option of simply not wearing a slip is not always available. This short cut is not appropriate with many fashionable clothes. The use of a half slip is also inappropriate under light-weight fabrics and knits, and the waistband makes it uncomfortable to wear after the birth of a child.

Thus there are no suitable alternatives to wearing a slip when a slip is called for fashionably or practically.

SOCIAL OBJECTIVES OF THE INVENTOR

In today's society, nursing mothers need no longer be separated from other persons in order to nurse a child if a coordinated and less awkward slip and nursing bra combination were available. A mother could get ready to go to work, including getting fully dressed, and then still nurse her baby at the last minute before taking the child to the babysitter or nursery.

A breast fed baby can have 8–12 ounces of formula given by the babysitter during the day and still be nursed by the mother otherwise. This will provide her child with the very valuable natural immunities and other health benefits of nursing. But to minimize the use of formula, a mother really needs to be able to modestly nurse her baby socially on many occasions, as well as in various places, all of which would be made feasible if quick and non-awkward clothing adjustments were available. Then others in the vicinity would see the event as being completely natural, and easily and modestly accomplished. It would not be a major hassle in any way, as it proves to be with conventional undergarments. In particular, new undergarment arrangements are needed to eliminate all of the attention-getting motions connected with the present requirement to pull the conventional slip shoulder strap down the arm.

With such new undergarment arrangements, the present need for a mother to resort to bottle feeding in many places outside the home can be eliminated. Then the baby can receive all of the physical, developmental and emotional advantages of breast feeding that numerous studies have shown to exist.

If an infant is given one or two ounces of formula from the age of two weeks on, as a break for the mother and for the enjoyment of the father and other relatives, then the infant will not balk at being given a daily bottle while the mother works. This perspective of a more reasonable role for bottle feeding could be achieved if more children were to be nursed.

Thus this inventor directed her efforts toward new nursing undergarment arrangements.

PRACTICAL OBJECTIVES OF THE INVENTOR

This inventor realized that, as a very practical matter, a nursing slip should be stylish, with adjustable shoulder straps to shorten or lengthen the slip to match the lengths of various dresses and skirts. The nursing feature should be invisible so that it could be worn as a regular slip after the nursing period is over. Thus the design of the slip's bosom should not have any visibly obvious separate nursing flap, as for example, the obvious separate nursing flap of the nursing bra. In addition, the nursing slip should be able to conceal the nursing feature or separate flap of a nursing bra worn underneath.

While it is important to provide for a completely integrated functional combination of the nursing slip or camisole and nursing bra, it is also desirable that these undergarments are not permanently tied together. Then they can be worn separately. There should be no requirement for a particular nursing bra embodying its coordinated feature to always be worn with a particular slip that similarly embodies its own feature of coordination. The system of coordination should be as simple and unobtrusive as possible, and it should allow the mother to select from her wardrobe any feature-equipped bra to go with any feature-equipped slip or camisole, on any occasion.

SUMMARY OF THE INVENTION

This invention allows the coordinated nursing slip and bra to be worn separately when desired. In combination, the slip bosom and the bra nursing flap open and close decorously and efficiently as a unit since they are surface connected. This surface connection also supports the slip when its shoulder straps are disconnected to open the unitary bosom. The opened slip shoulder straps are retained on the bra so that they do not become lost during nursing under the wearer's clothing.

DETAILED DESCRIPTION OF THE DRAWINGS

Figure 1:
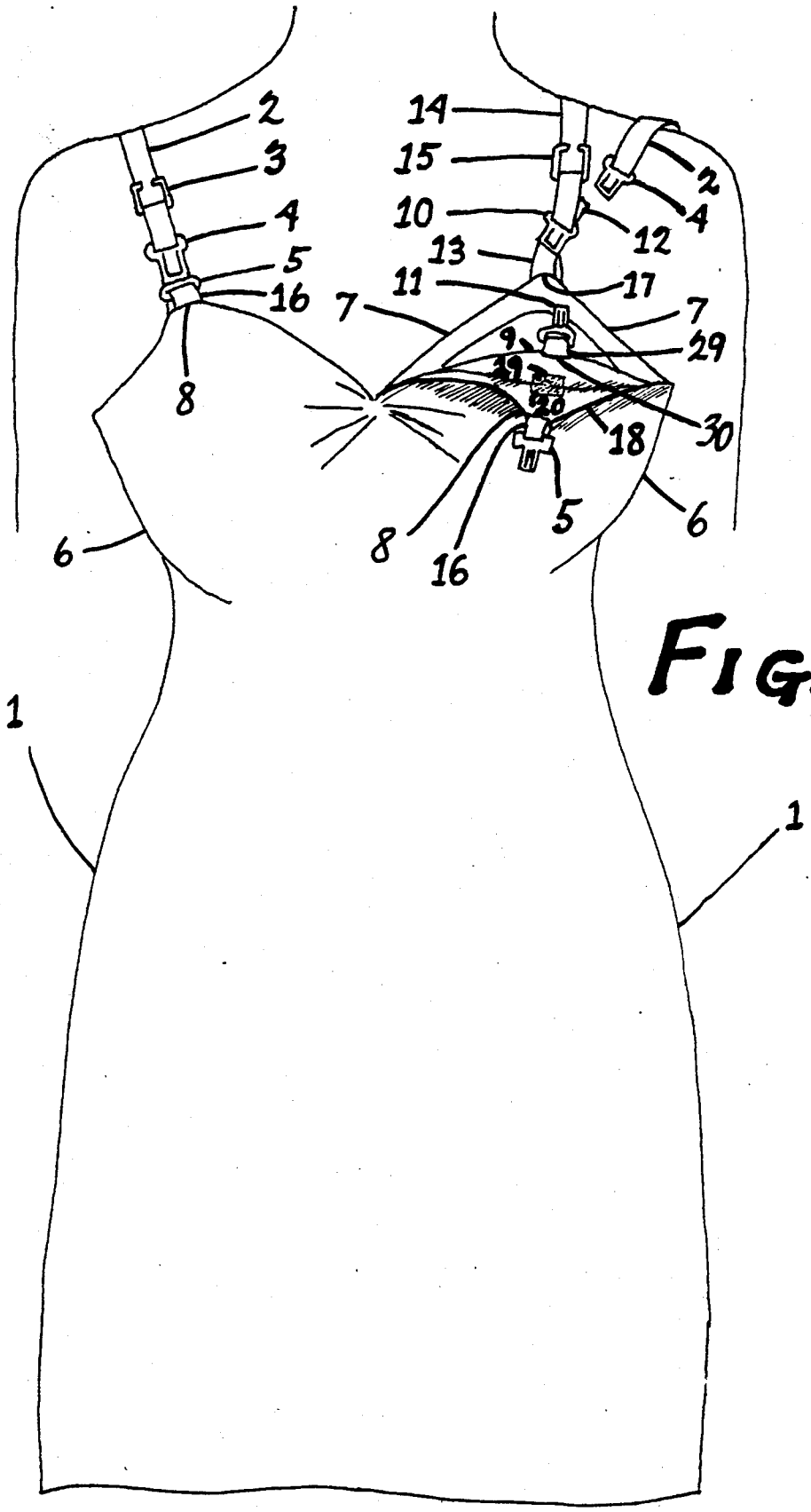
FIG. 1 shows a full length nursing slip according to the present invention, that has been opened on one side, thereby revealing those portions of a subjacent coordinated nursing bra also according to the present invention, that become visible.

The cloth structure of the slip 1 in FIG. 1 is regular and conventional, but the slip can also be opened in accordance with this invention to permit the mother to nurse. The slip is supported by two conventional shoulder straps 2. Each shoulder strap has a conventional adjustment fitting 3 to shorten or lengthen the slip. But unlike the regular slip, detachable clasp fasteners 4 and 5 are shown closed on one side of the bosom 6 and open on the other side. On the opened side, the shoulder strap adjustment fitting has slipped out of view behind the wearer's left shoulder. On the closed side, the slip parts 2, 3, 4, and 5 completely hide from view the subjacent shoulder strap of the subjacent nursing bra 7. On the opened side, the bra comes into view when the apex 8 of the bosom is lowered. The nursing bra has a nursing flap or drop cup 9 which is opened by detaching the closure clasp fasteners 10 and 11. The front end of the opened slip shoulder strap can be handily retained by connecting fasteners 4 and 12, which anchor it to the nursing bra closure clasp strap 13. When not in use, fastener 12 is kept hidden in an invisible fabric loop of the closure clasp strap. The nursing bra shoulder strap 14 has its own adjustment fitting 15. The fasteners shown in FIG. 1, as well as the remainder of the figures, are of the locking-plug (such as 5 on the slip and 11 and 12 on the bra) to push-to-release-socket (such as 4 on the slip and 10 on the bra) type. There are a great variety of equivalent fasteners which will work acceptably. But those of the Bonnie® type are very convenient, hold well, and are extremely easy to release by pressing. Note that a small ribbon loop 16 provides the conventional anchoring to the apex 8 on the slip, while a similar conventional ribbon loop 29 provides the anchoring at the apex 30 of the nursing flap 9 of the bra. The closure clasp strap 13 is attached to the apex 17 of the bra.

A most important connection is made in FIG. 1 between the nursing flap 9 of the bra and the lowered portion 18 of the bosom of the slip. This is accomplished on an area-holding basis by means of hook-loop fastener patches 19 and 20. They are shown separated slightly for illustrative purposes, and they are smaller than one would use in practice for drawing convenience. 19 is on the outside of the subjacent bra, while 20 is on the inside of the superjacent slip bosom. So that sweaters and knits can be worn over the bra without a slip, 19 should be a patch of the soft loop type, while 20 becomes the mating sticky hook type patch. The function of the locked-together patches is to allow convenient and decorous opening of the bosom of the slip and the nursing bra flap or drop cup as a unit. Reclosure of this unitary structure after nursing is also very easy and decorously accomplished. Furthermore, once the bosom is reclosed, the wearer does not have to grope around for the shoulder strap end, which has been positively retained. The patches also allow the bra shoulder straps to support the slip perfectly during nursing, even though the slip shoulder straps have been disconnected. Hence reconnection of the slip shoulder straps is simply done, as the strap is never too short to reach a fallen slip apex, since the apex is positively retained and cannot creep down during nursing. The area of the hook-loop patches can be adjusted to provide the degree of retention required by the physical characteristics of the wearer. The favored texture of patch holding surface for this type of undergarment service is found in Craft Weight Velcro®.

Figure 2:
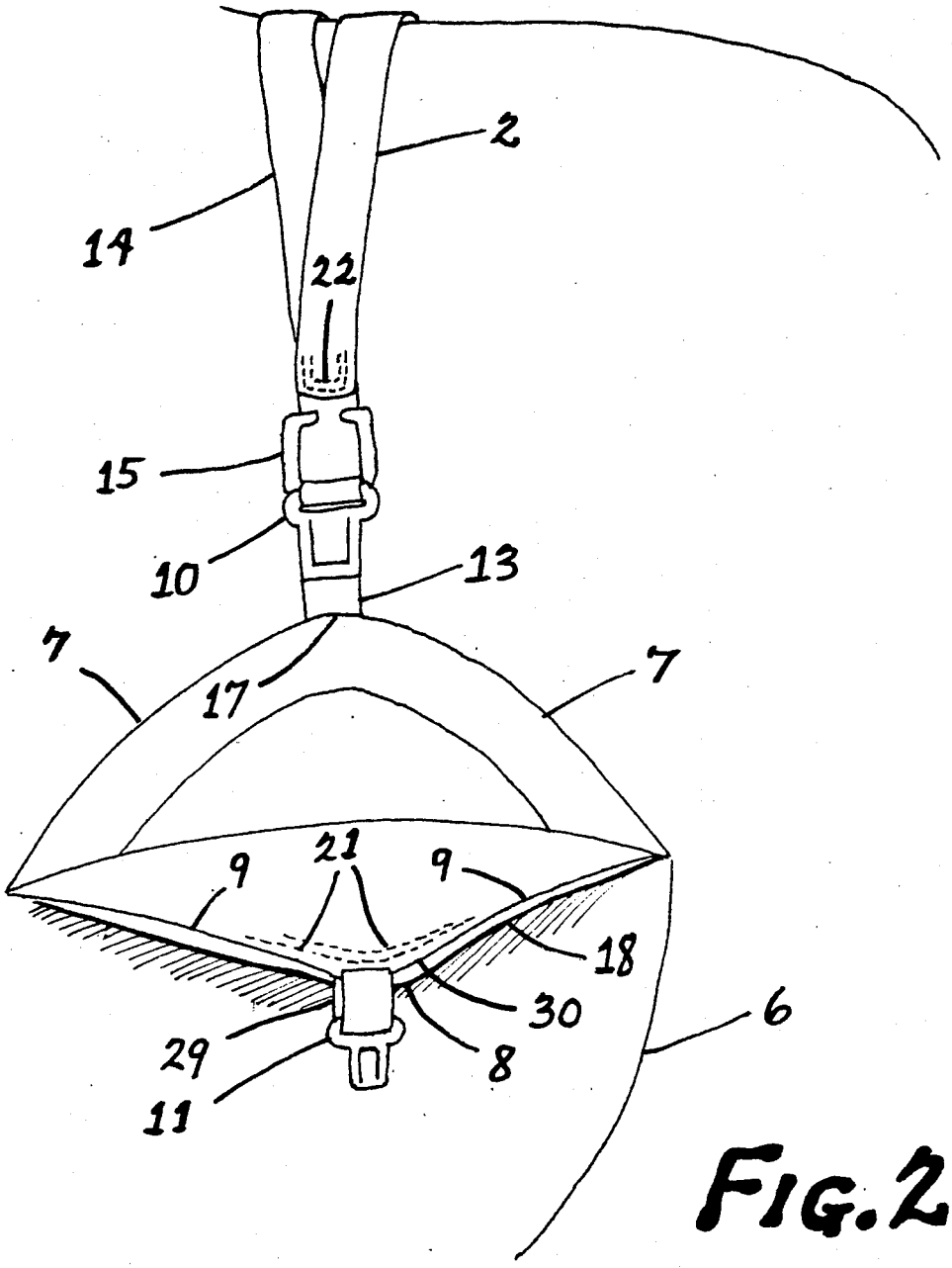
FIG. 2 illustrates an embodiment of the present invention in which the coordinated nursing slip and nursing bra are permanently attached by stitching.

In FIG. 2, the separable hook-loop patch is replaced by permanent stitching 21. The area around the apex 8 of the bosom is sewn to the nursing flap or drop cup 9. This makes a unitary flap that is readily controlled by by the closure clasp locking-plug 11 and the push-to-release-socket 10. The front end of the slip is held up by the stitching 21. The obvious disadvantage of this arrangement is that the slip and bra cannot be worn separately. After the nursing period is over, the slip is not available without disassembly and reconstruction, which is required by the cutting of the slip shoulder strap above the adjustment fitting 15, where it has been attached to the bra shoulder strap 14 by stitching 22.

Figure 3:
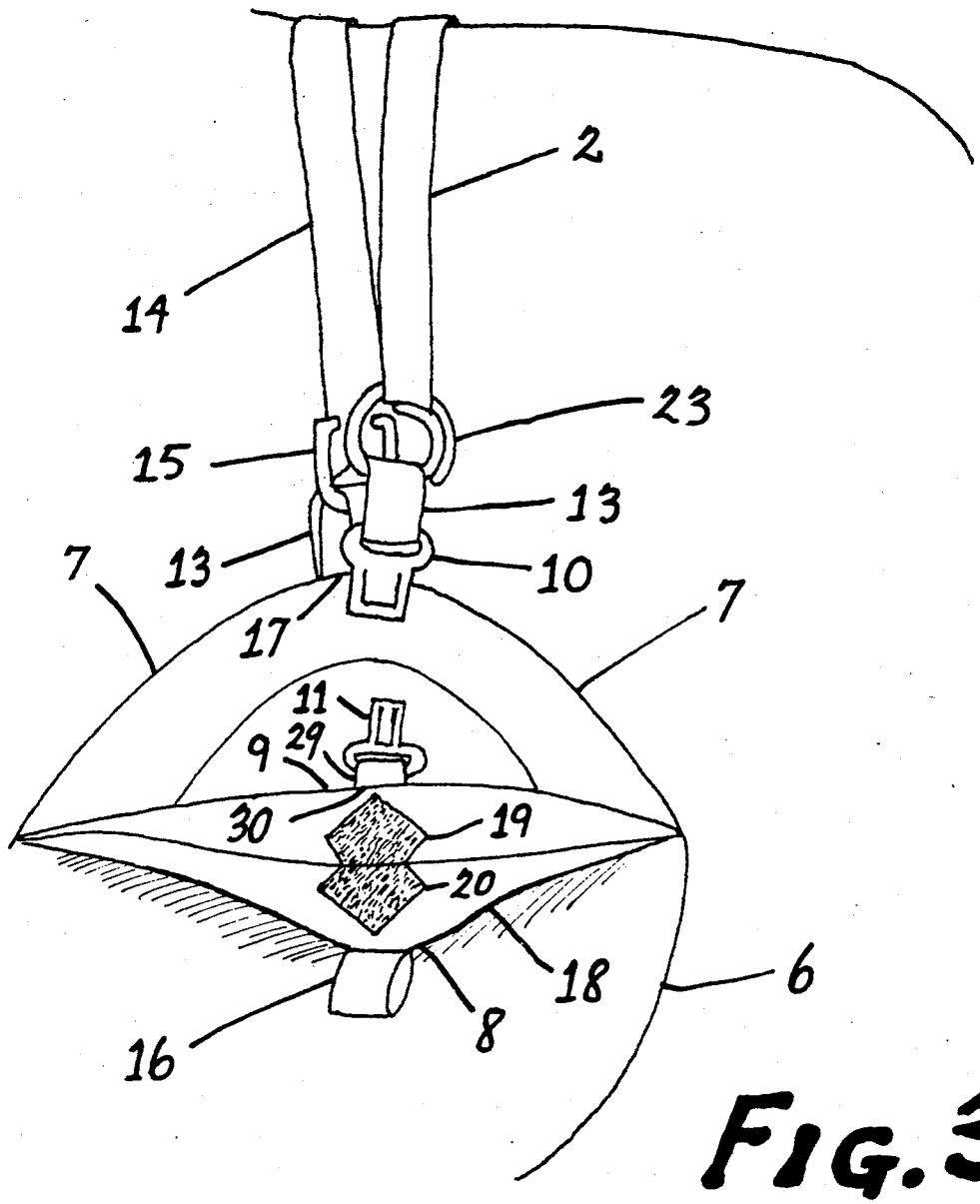
FIG. 3 depicts the manner in which the present invention can be retrofitted into a conventional slip and a conventional nursing bra.

FIG. 3 illustrates the retrofitting of the invention into a conventional slip and a conventional nursing bra. A sewing kit for accomplishing this would contain hook-loop patches 19 and 20 and a key-ring type of threadable overlapping split segment ring 23. Referring to FIG. 3, in a conventional slip the ribbon loop 16 at the apex 8 of the bosom 6 is connected permanently to the slip shoulder strap 2 by a permanently closed oval or ring that must be cut away and hence does not appear in the figure. This oval is replaced by the threadable and removable ring 23, which is shown in FIG. 3 providing the function of retaining the front end of the slip shoulder strap by anchoring it to the closure clasp strap 13 of the bra 7. 19 is a looped fastener patch sewn to the outside of the nursing flap 9, while 20 is the mating hooked fastener patch sewn on the inside of the lowered portion 18 of the bosom of the slip. 11 is the plug and 10 the push-to-release socket constituting the nursing flap closure clasp. 14 is the bra shoulder strap whose length is controlled by adjustment fitting 15. It is easy to reconnect the slip shoulder strap 2 to the slip ribbon loop 16 using the threadable ring 23 after the unitary flap has been closed by uniting the closure clasp fasteners 10 and 11. The hook-loop patches are again shown peeled back for drawing convenience. In practice, the orientation of the patch corners that is shown, that of being pointed toward the apexes 8 and 30 is good. In practice, the apexes are themselves quite pointed, which is hard to show in the figure. Also, in practice, there need not be much area between the patch and the border of the nursing flap or the slip bosom around each apex. While the area of the patch itself can usually be made much larger than required for holding purposes, ordinarily ¾ inch patch squares, situated on the diagonal as illustrated in FIG. 3, are adequate for most retrofit applications. This size of patch does not damage the slip appearance and, once the nursing period is over, the slip can again be worn as a regular slip without giving any suggestion of its earlier function.

Figure 4:
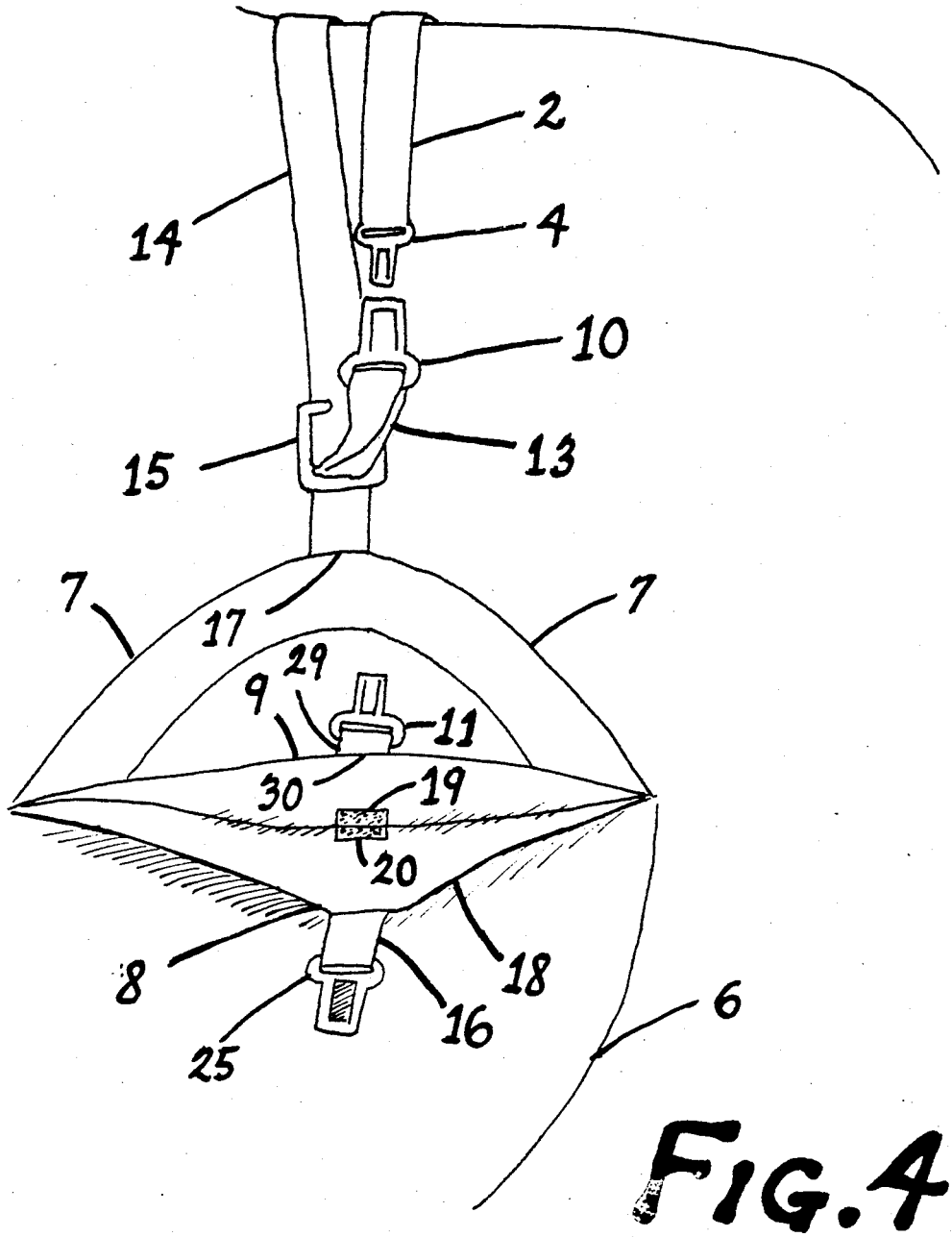
FIG. 4 shows the invention utilizing identical fasteners of the locking-plug to push-to-release-socket type for both the nursing slip and the nursing bra clasps. However, the clasps are oriented identically.

Examination of FIG. 4 shows that the push-to-release-socket fastener 10 serves to anchor either the slip shoulder strap plug fastener 4 or the bra nursing flap plug fastener 11. When the flap is closed, fastener 4 goes into socket 25 to close the unitary bosom created by the adherence of patches 19 and 20. Note that a twist in the closure clasp strap 13 is required, which is disadvantageous. This is caused by the fact that plug fasteners 4 and 11 have the same orientation with respect to the surface of the wearer's body.

THE PREFERRED EMBODIMENT

Figure 5:
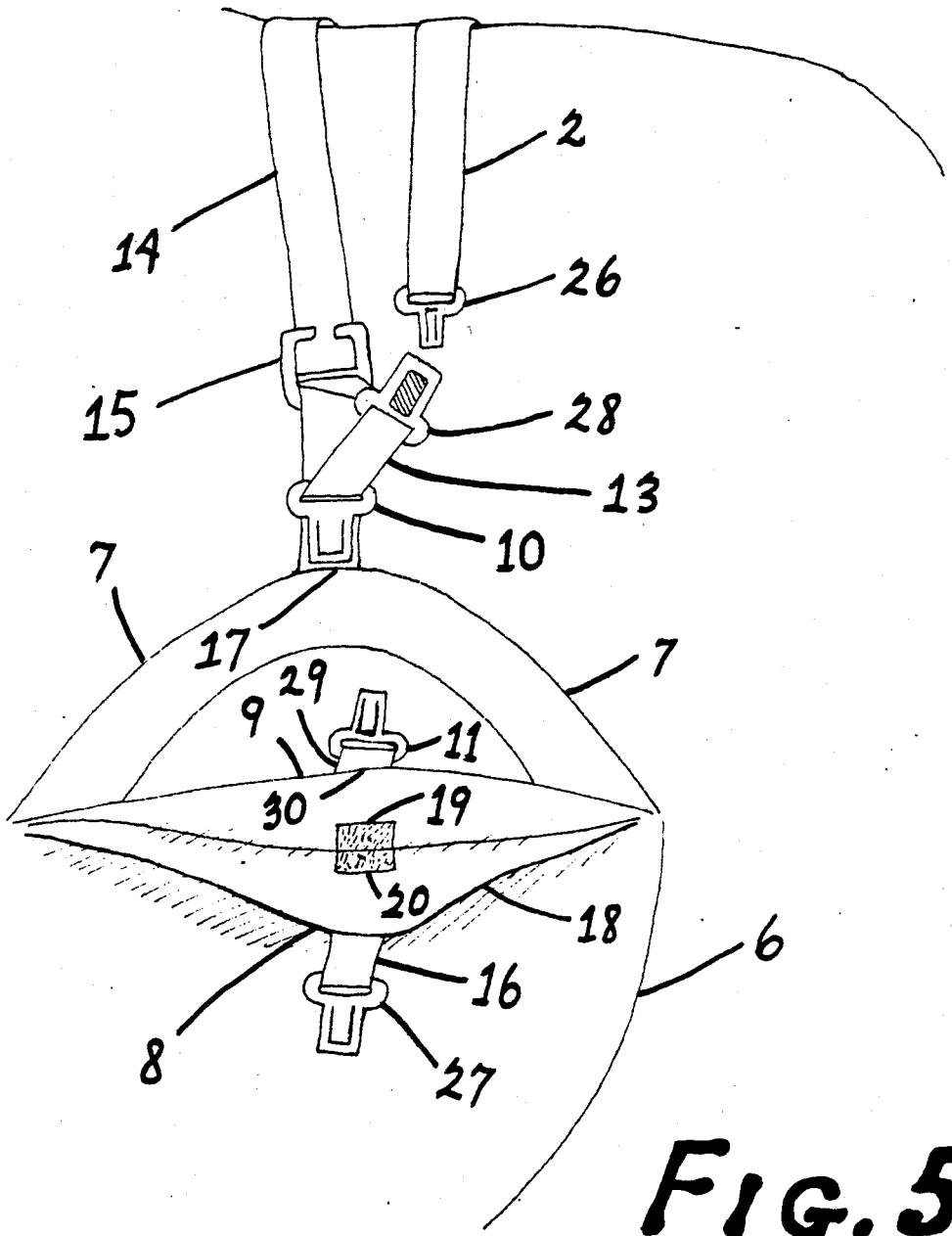
FIG. 5 presents the preferred embodiment, which employs on improved clasp orientation.

FIG. 5, which depicts the preferred embodiment, eliminates the need to twist the closure clasp strap 13 by means of adding a second socket fastener 28 on the closure clasp strap. Some other fastener orientations have been altered to illustrate that a number of variations are possible. Here, the orientations of 26, 27, and 28 are opposite to their counterparts 4, 25, and 10 of FIG. 4. The recommended preferred embodiment fasteners for straps are Bonnie®, while the recommended hook-loop patches are Craft Weight Velcro®. Although it is not recommended and therefore not shown in the preferred embodiment, the reader will recognize that, given the new orientation of fasteners 26 and 27, fastener 10 will now engage fastener 26 to retain the slip shoulder strap 2 without any need to twist the closure clasp strap 13. Thus two closure clasp assemblies are the minimum number required. There is a distinct advantage of convenience in operation to have both 28 and 10 present, for then the slip strap can be retained while the nursing flap is being closed, assuring that the front end of the shoulder strap will not be lost during that operation. Also, in practicing the preferred embodiment, one should locate the hook-loop patches as tightly as possible into the apex regions, which depends upon the shapes of the nursing flap of the bra and the bosom of the slip.

I claim:

1. A coordinated nursing slip, for breast feeding an infant while wearing a subjacent coordinated nursing bra having features that are harmoniously complementary to said slip, in order to allow (a) convenient and decorous simultaneous opening of the bosom of the slip and the nursing flap of the bra as a unit, and (b) support of the opened slip by the bra, and (c) handy retention of the opened slip shoulder strap front end, so as to prevent it from becoming inadvertently lost during nursing, and (d) easy reclosure of the unitary slip bosom and nursing flap, comprising:

a slip with openable strap fastening mens for attaching the front end of each shoulder strap of said slip to the corresponding apex of the bosom of said slip or to a bra retaining location, and second fastening means for attaching the inside of said bosom just below each apex of said bosom to the outside of the corresponding nursing flap of said subjacent bra just below the closure clasp of said flap.

2. A coordinated nursing slip according to claim 1 wherein said second fastening means is permanent, such as stitching or equivalent.

3. A coordinated nursing slip according to claim 1 wherein said second fastening means is separable, using a hook-loop type fastener patch or equivalent.

4. A coordinated nursing slip according to claim 2 or 3 wherein said openable strap fastening means is a locking-plug to push-to-release-socket type of fastener such as Bonnie® or equivalent.

5. A coordinated nursing bra, for breast feeding an infant while wearing a superjacent coordinated nursing slip having features that are harmoniously complementary to said bra, in order to allow (a) convenient and decorous simultaneous opening of the bosom of the slip and the nursing flap of the bra as a unit, and (b) support of the opened slip by the bra, and (c) handy retention of the opened slip shoulder strap front end, so as to prevent it from becoming inadvertently lost during nursing, and (d) easy reclosure of the unitary slip bosom and nursing flap, comprising:

a nursing bra with fastening means for attaching the outside of each nursing flap of said bra just below the closure clasp of said flap to the inside of the bosom of said superjacent slip just below the corresponding apex of said bosom.

6. A coordinated nursing bra according to claim 5 wherein said fastening means is permanent, such as stitching or equivalent.

7. A coordinated nursing bra according to claim 5 wherein said fastening means in separable, using a hook-loop type fastener patch or equivalent.

8. A coordinated nursing bra according to claim 6 or 7 further comprising:

retaining means for attaching each closure clasp strap of said bra to the front end of the adjacent shoulder strap of said superjacent slip, such that each of said closure clasp straps of said bra becomes a handy slip shoulder strap retaining location.

9. A coordinated nursing bra according to claim 6 or 7 wherein the closure clasp of each nursing flap of said bra is the same device as the openable strap fastening means of said superjacent slip, such that each nursing flap closure clasp anchor location on said bra becomes a handy slip strap retaining location, and the front end of each shoulder strap of said superjacent slip can then be connected either to the corresponding apex of the bosom of said slip, or to replace the adjacent closed nursing flap of said bra when said adjacent nursing flap is opened to nurse.

10. A coordinated nursing bra according to claim 8 wherein said retaining mens is a locking-plug to push-to-release-socket type of fastener such as Bonnie® or equivalent.

11. A coordinated nursing bra according to claim 9 wherein said closure clasp of said bra and said openable strap fastening means of said slip are locking-plug to push-to-release-socket type of fasteners such as Bonnie® or equivalent.

12. A nursing slip, for breast feeding an infant while wearing a subjacent nursing bra, with features to allow (a) convenient opening of the bosom of the slip to access the nursing flaps of the bra, and (b) handy retention of the opened shoulder strap front end, so as to prevent it from becoming inadvertently lost during nursing, comprising a slip with openable strap fastening means for attaching the front end of each shoulder strap of said slip either to the corresponding apex of the bosom of said slip, or to an alternate retaining location at the closure clasp strap of said subjacent bra.

13. A nursing slip according to claim 12 wherein said openable strap fastening means is the same device as the closure clasp of each nursing flap of said subjacent bra, such that each nursing flap closure clasp anchor location on said bra becomes a handy slip strap retaining location, and the front end of each shoulder strap of said slip can then be connected either to the corresponding apex of the bosom of said slip, or to replace the adjacent closed nursing flap of said bra when said adjacent nursing flap is opened to nurse.

14. A nursing slip according to claim 13 wherein said openable strap fastening means of said slip and the closure clasp of each nursing flap of said subjacent bra are locking-plug to push-to-release socket type of fasteners such as Bonnie® are equivalent.

15. A coordinated nursing slip according to claim 2 or 3 wherein said openable strap fastening means is the same device as the closure clasp of each nursing flap of said subjacent bra, such that each nursing flap closure clasp anchor location on said bra becomes a handy slip strap retaining location, and the front end of each shoulder strap of said slip can be then be connected either to the corresponding apex of the bosom of said slip, or to replace the adjacent closed nursing flap of said bra when said adjacent nursing flap is opened to nurse.

* * * * *